US006355117B1

(12) United States Patent
DeLuca et al.

(10) Patent No.: US 6,355,117 B1
(45) Date of Patent: Mar. 12, 2002

(54) NICKEL BASE SUPERALLOY SINGLE CRYSTAL ARTICLES WITH IMPROVED PERFORMANCE IN AIR AND HYDROGEN

(75) Inventors: Daniel P. DeLuca, Tequesta; Bradford A. Cowles, Palm Beach Gardens, both of FL (US); Maurice L. Gell; David N. Duhl, both of Newington, CT (US); Alan D. Cetel, West Hartfort, CT (US); Charles M. Biondo, Jupiter, FL (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/516,677

(22) Filed: Mar. 1, 2000

Related U.S. Application Data

(63) Continuation-in-part of application No. 09/034,594, filed on Mar. 4, 1998, now abandoned, which is a continuation-in-part of application No. 08/246,371, filed on Apr. 26, 1994, now abandoned, which is a continuation of application No. 07/968,757, filed on Oct. 30, 1992, now abandoned.

(51) Int. Cl.[7] ..... C22C 19/05
(52) U.S. Cl. ..... 148/404; 148/428; 420/443
(58) Field of Search ..... 148/404, 428, 148/677, 675; 420/443, 448, 449, 450

(56) References Cited

U.S. PATENT DOCUMENTS

| | | | | |
|---|---|---|---|---|
| 4,099,992 A | | 7/1978 | Pugliese et al. | 148/11.5 N |
| 4,245,698 A | | 1/1981 | Berkowitz et al. | 166/244 |
| 4,400,209 A | | 8/1983 | Kudo et al. | 420/443 |
| 4,400,210 A | | 8/1983 | Kudo et al. | 420/443 |
| 4,400,211 A | | 8/1983 | Kudo et al. | 420/443 |
| 4,400,349 A | | 8/1983 | Kudo et al. | 420/443 |
| 4,421,571 A | | 12/1983 | Kudo et al. | 148/11.5 R |
| 4,677,035 A | | 6/1987 | Fiedler et al. | 428/680 |
| 4,802,934 A | | 2/1989 | Ohno et al. | 148/404 |
| 4,849,030 A | * | 7/1989 | Darolia et al. | 148/404 |
| 4,885,216 A | | 12/1989 | Naik | 428/680 |
| 5,077,141 A | | 12/1991 | Naik et al. | 428/680 |
| 5,395,584 A | | 3/1995 | Berger et al. | 420/443 |
| 5,725,692 A | | 3/1998 | DeLuca et al. | 148/410 |

* cited by examiner

*Primary Examiner*—Deborah Yee
(74) *Attorney, Agent, or Firm*—Charles E. Sohl

(57) ABSTRACT

Compositional requirements and processing improvements are disclosed which improve the hydrogen embrittlement resistance and the fatigue resistance in air of nickel base single crystal articles. The compositional requirements enlarge the difference between the γ' solvus temperature and the incipient melting temperature, thus enabling the solution of γ/γ' eutectic islands without causing incipient melting, while hot isostatic pressing and careful melt practice eliminate porosity and carbides, borides and nitrides, all of which act as crack initiation sites.

1 Claim, 4 Drawing Sheets

100X

100X

100X

100X

500X

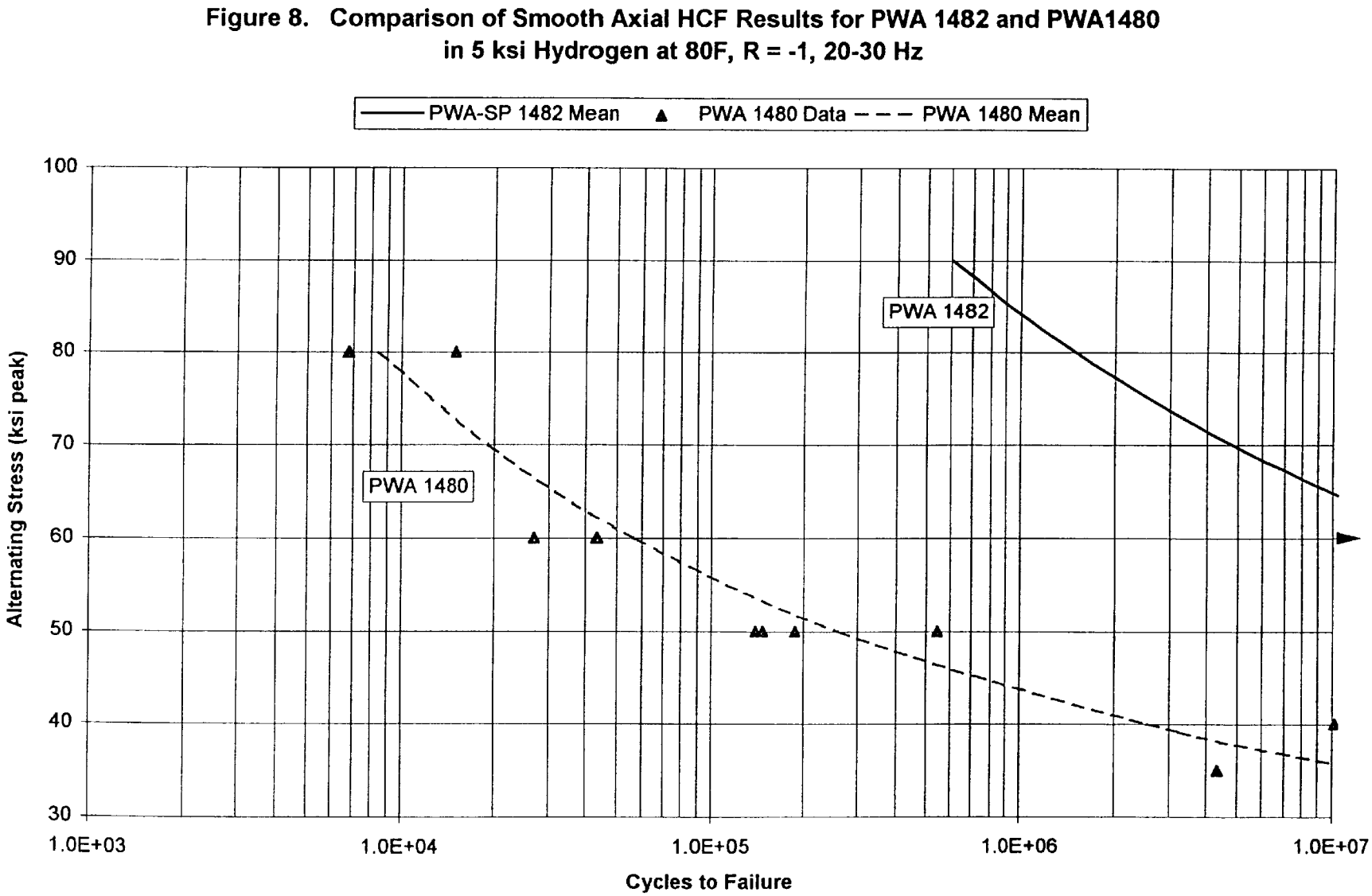
Figure 8. Comparison of Smooth Axial HCF Results for PWA 1482 and PWA1480 in 5 ksi Hydrogen at 80F, R = -1, 20-30 Hz

NICKEL BASE SUPERALLOY SINGLE CRYSTAL ARTICLES WITH IMPROVED PERFORMANCE IN AIR AND HYDROGEN

This application is a CIP of 09/034,594 filed Mar. 4, 1998, which is a CIP of 08/246,371 filed Apr. 26,1994 which is a CON of 07/968,757 filed Oct. 30, 1992, all cases now abandoned.

TECHNICAL FIELD

This invention relates to nickel base superalloy articles possessing improved resistance to hydrogen embrittlement, and also improved fatigue resistance in air. The invention comprises a combination of aspects including composition, and heat treatment which produce an unexpected improvement in properties in certain environments. The invention primarily comprises a limited composition range in combination with a specific heat treatment and a HIP treatment. The result of this product has the unique combination of properties previously described.

BACKGROUND OF THE INVENTION

The present invention deals with improvements to the hydrogen embrittlement resistance to fatigue failure of high strength nickel base superalloy single crystal articles. The invention aspects which provide the improvements to hydrogen embrittlement resistance also provide significant benefits to the fatigue behavior of the materials when used in an air atmosphere where gas turbines operate.

High strength nickel base superalloys are defined in the context of this invention as nickel base alloys containing more than about fifty volume percent of the strengthening γ' phase and having a yield strength in excess of about 100 ksi at 1000° F. Such alloys find their widest, and heretofore almost exclusive, application in the field of gas turbine engines. These alloys are also used in liquid hydrogen fueled rocket propulsion systems where hydrogen embrittlement is a limiting factor in the life cycle. In the development of the NASA Space Shuttle main engines, hydrogen embrittlement has been recognized to be a significant problem. The Space Shuttle main engines are rocket engines which mix and react liquid hydrogen and liquid oxygen to form the propellant. These reactants are pumped into the main combustion chamber by turbo pumps which are powered by the combustion products of the reaction of hydrogen and oxygen. The hot side of the turbo pumps, which is exposed to the combustion products of the hydrogen/oxygen reaction, includes a multiplicity of small turbine blades which are currently investment cast from either directionally solidified Mar-M 246 alloy or single crystal PWA-SP1493. (Nominal compositions shown in Table I). Both alloys meet the previous definition of a high strength nickel base superalloy in that they contain more than fifty volume percent of the γ' phase and have a yield strength of more than 100 ksi at 1000° F. Hydrogen embrittlement of these turbine blades is a problem of great concern and is one of the factors which requires the space shuttle main engine pumps to be rebuilt with substantially greater frequency than originally anticipated.

The initiation of hydrogen embrittlement cracking in nickel base single crystal superalloys is commonly observed at low temperatures (near 26 C.) and has been found to occur within the γ/γ' eutectic islands where cracks form between the eutectic lamella. This is in contrast to air breathing gas turbine experience where cracks usually form at elevated temperature from a number of microstructural discontinuities such as pores, hard particles and interfaces between precipitated phases and the matrix.

SUMMARY OF THE INVENTION

According to the present invention, a class of nickel base superalloy compositions is described which can be processed to provide a high strength nickel base single crystal superalloy material which is in particular, highly resistant to hydrogen embrittlement. The principles taught in this invention also provide marked increases in the fatigue resistance of these alloys when used in more common applications, such as gas turbine engines.

The mechanism of the present invention is twofold:

(1) In the presence of high pressure hydrogen, i.e. in cryogenic rocket propulsion systems, the normally benign γ/γ' eutectic islands inherent in Ni base turbine blade alloys become active fatigue crack initiators. Eliminating these eutectic islands thus significantly retards cracking in the presence of hydrogen and (2) Microstructural features acting to reduce fatigue life in atmospheres other than high pressure hydrogen, namely those atmospheres encountered in gas turbine propulsion systems include hard carbide, boride and nitride particles, and, most significantly, microscopic interdendritic porosity. The elimination of these potential fatigue crack initiation sites thus significantly retards cracking in the gas turbine environment.

Maintaining levels of carbon, boron and nitrogen in the master melt as low as possible, and minimizing any introduction of carbon, boron or nitrogen during casting minimizes the amount of the hard phases which can form during the casting process.

The invention composition range, presented in Table II, in the as cast condition, contains a greatly reduced amount of eutectic γ/γ' phase relative to the typical prior art alloys. The invention composition is also particularly suited for heat treatment to fully dissolve, and thereby eliminate, the eutectic γ/γ' islands without causing incipient melting to occur in the alloy.

The invention also provides an optimum (Ni+Co)/Cr ratio, which provides maximum fatigue strength in both air and hydrogen. The ratio, (nickel+cobalt)/chromium in atomic percent in the γ matrix phase, should be in the range of 1.5 to 3.0. We have found that controlling this ratio in this range is important in obtaining the maximum alloy tensile strength and fatigue strength.

Material which satisfies the compositional rules is solidified from the melt, then hot isostatic pressing is preferably used to close any porosity which might be present, and solution heat treatment at a temperature above the γ' solvus temperature is conducted to dissolve the γ/γ' eutectic islands without causing incipient melting. The article is then given conventional lower temperature heat treatments to produce a γ' morphology which tailors the mechanical properties of the material to meet the requirements of the particular application. The resultant product is a high strength nickel base superalloy article which has significantly improved resistance to fatigue in air as well as resistance to hydrogen embrittlement.

The alloy composition and processing techniques disclosed and claimed herein are directed toward single crystal materials. Elements such as carbon and boron, which are known to form hard particles in single crystal materials and act as crack initiation sites, are substantially excluded from this invention. However, their presence is frequently required for grain boundary strengthening, so the teachings of this invention are not directly applicable to polycrystalline and columnar grain materials.

The foregoing and other features and advantages of the present invention will become more apparent from the following description and accompanying figures.

BRIEF DESCRIPTION OF THE FIGURES

FIG. 8 is a graph comparing the relative high cycle fatigue (HCF) behavior in a hydrogen atmosphere of the same materials as shown in FIG. 6.

BEST MODE FOR CARRYING OUT THE INVENTION

The present invention comprises a particular class of compositions of nickel base superalloy single crystal materials which have, in the as cast condition, a minimal amount of hard phases, including carbides, borides, and nitrides, along with a reduced amount of eutectic γ/γ' islands compared to prior art materials. The present invention materials are uniquely adapted to be heat treated at elevated temperatures so as to eliminate the remainder of the eutectic γ/γ' islands which may be present.

The present invention materials (alternately referred to herein as eutectic-free pore-free material) are high strength nickel base superalloy single crystal materials having a yield strength greater than 100 ksi at 1000° F. The materials contain a fine distribution of the γ' $Ni_3(Al+Ti)$ strengthening phase, with the amount ranging generally from fifty to seventy volume percent, and a refractory content (W+Mo+Ta+Cb) which is greater than or equal to about ten weight percent. Table II describes the invention composition range.

Table 1 contains examples of alloys whose nominal compositions satisfy the compositional relationships discussed above, along with a similar prior art alloy (PWA 1480, the subject of U.S. Pat. No. 4,116,723) whose nominal composition (listed in Table 1) does not satisfy the compositional relationships.

Figure 1:
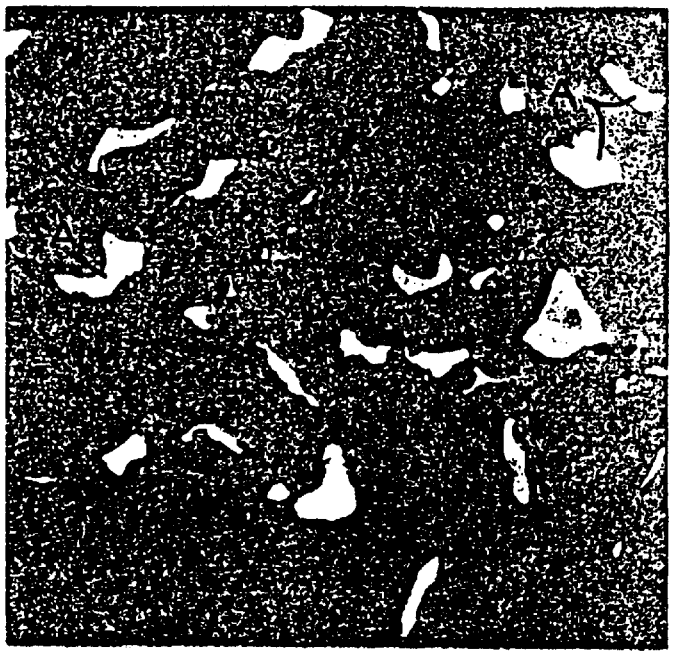
FIG. 1 is a photomicrograph of a typical prior art nickel base superalloy material (PWA 1480) after the standard prior art solution heat treatment, containing about five volume percent γ/γ' eutectic islands.

PWA 1480 is a nickel base superalloy used in the single crystal form for gas turbine engine airfoils. The microstructure of this alloy after the conventional solution heat treatment is shown in FIG. 1. Low levels of various carbides, borides and nitrides are present, along with approximately 5 volume percent γ/γ' eutectic islands (A). The material has not been subjected to hot isostatic pressing, so porosity is still present. This alloy is suitable for its intended purpose (air breathing gas turbine engines) in the condition shown. When PWA 1480 alloy was evaluated for use in a hydrogen atmosphere, it was found to be more resistant to hydrogen embrittlement, than other conventional superalloys, but that hydrogen embrittlement still severely reduced the fatigue capabilities of the alloy to an unacceptable degree. In fatigue testing in air, it was determined that fatigue cracks initiated at the sites of the pores, carbide, nitride, and boride particles. In hydrogen, cracks appeared to initiate within the γ/γ' eutectic islands with the initiation of cracking occurring much sooner in hydrogen than in air.

Thus, it appeared that the elimination of the γ/γ' eutectic islands should improve the performance of the alloys in hydrogen.

It was determined that sufficiently low levels of carbides, borides and nitrides could be obtained by not intentionally adding carbon and boron to the alloy and keeping nitrogen low in both the melting process and the casting process. Porosity is readily eliminated by hot isostatic pressing. Solutioning the γ/γ' eutectic islands in PWA 1480 was found to be difficult because the temperature required to dissolve the γ/γ' eutectic islands closely approached the melting point of the alloy in localized areas and incipient melting was found to be virtually unavoidable during solution heat treatment.

Figure 2:
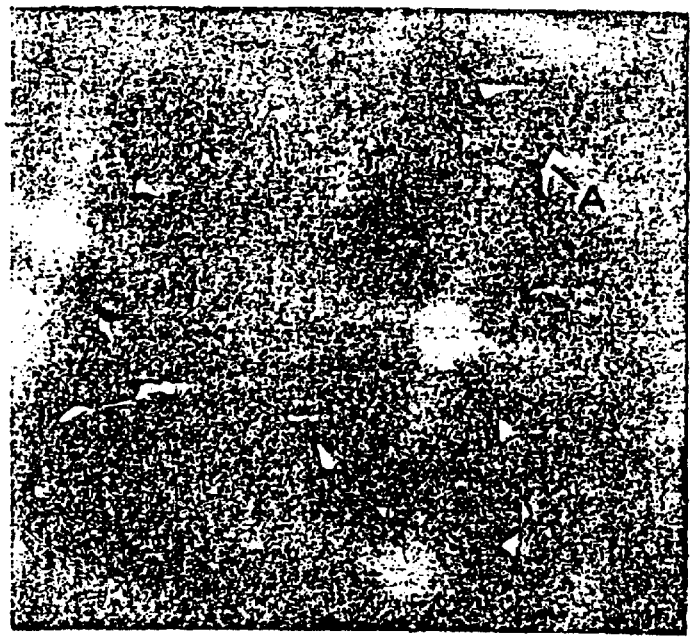
FIG. 2 is a photomicrograph of a nickel base superalloy material (PWA 1482) according to the present invention after the standard prior art solution heat treatment containing less than one volume percent γ/γ' eutectic islands.

As shown in FIG. 2, alloys which satisfy these relationships contain low levels of carbide, boride and nitride particles and a greatly reduced volume of the γ/γ' eutectic islands after the standard solution treatment has been applied. However the remaining γ/γ' eutectic islands still serve as crack initiation sites, and thus make the material only marginally better than the prior art materials.

Figure 3:
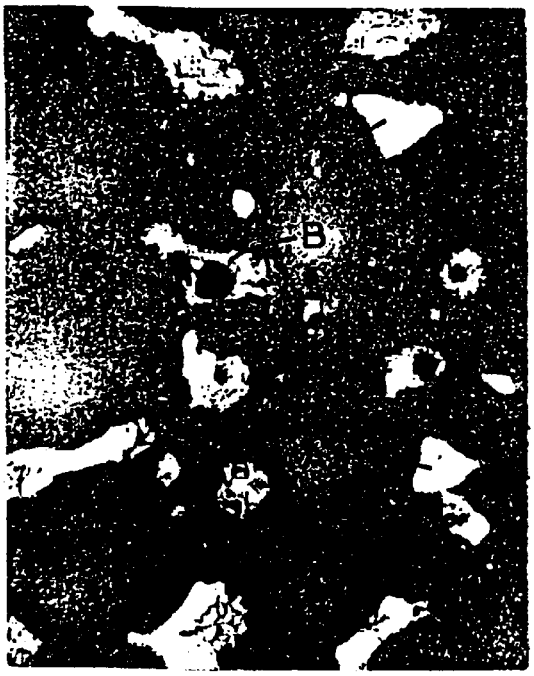
FIG. 3 is a photomicrograph of PWA 1480 showing the incipient melting which occurs when attempting to heat treat above the standard alloy solution heat treatment to fully dissolve the γ/γ' eutectic islands.

FIG. 3 shows the microstructure of PWA 1480 alloy after applying a solution heat treatment at a temperature which is higher than the commonly employed solution temperature and which is intended to dissolve the eutectic phase. Both undissolved γ/γ' eutectic islands (A) and areas of incipient melting (B) are present, both of which can act as crack initiation sites. This shows that temperatures which are not yet high enough to dissolve the eutectic phase are already high enough to cause some localized melting in portions of the prior art material.

Figure 4:
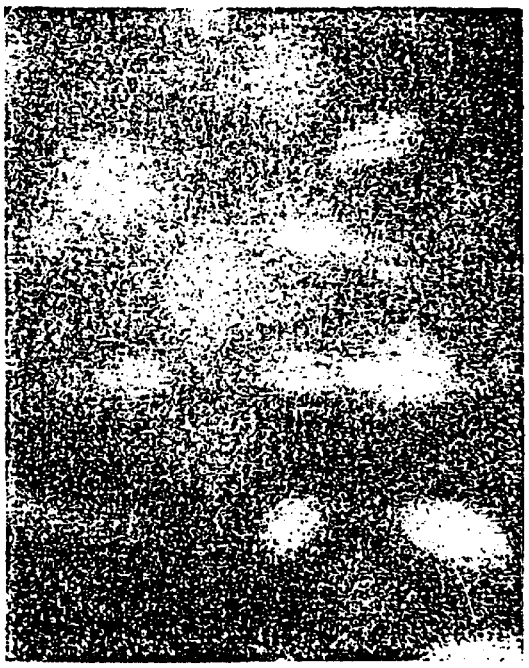
FIG. 4 is a photomicrograph of PWA 1482 material according to the present invention after hot isostatic pressing and solution heat treatment showing the complete elimination of the eutectic γ/γ' phase and all porosity.

FIG. 4, on the other hand, shows the same material as in FIG. 2, i.e., material which satisfies the compositional relationships of this invention, after hot isostatic pressing to eliminate porosity and the-appropriate solution heat treatment. For the invention alloy, the appropriate solution heat treatment temperature is from 2350° F. to a temperature immediately below the incipient melting point of the alloy, preferably from 2380° F. to a temperature immediately below the incipient melting point of the alloy, and most preferably from about 2380° F. to about 2420° F. Heat treatment times of from 1–10 hours are preferred. The γ/γ' eutectic islands have been completely dissolved by heating at a temperature between the γ' solvus temperature and the incipient melting temperature for about four hours. While solution temperatures for prior art processing are normally held at or below the γ' solvus temperature, which can leave up to about 20% by volume of the γ' and up to about 10 percent by volume of the γ/γ' eutectic islands undissolved, the solution temperature for this invention is 10–25° F. above the matrix γ' solvus temperature. This is necessary to ensure complete solution of the γ' particles and the γ/γ' eutectic islands. The upper limit of the solution temperature must be below the incipient melting temperature to prevent localized melting. A varied heating rate, such as is described in U.S. Pat. No. 4,717,432, of common assignee herewith, is preferably employed to dissolve the γ/γ' eutectic islands without causing incipient melting.

A rapid cooling rate after solution equal to or greater than 100° F. per minute to a temperature less than 1000° F. is required. Completion of the heat treat cycle using the conventional stabilization cycle of 1975° F. for about four hours, cooling to less than 1000° F. at 10° F. per minute or faster, aging at about 1600° F. for 24–32 hours, and cooling to less than 1000° F. at 10° F. per minute or faster generates a γ' morphology mechanical properties which are improved over the prior art materials. An essentially homogeneous microstructure is produced which is essentially free of preferred crack initiation sites in either air or hydrogen environments, significantly retarding initiation and propagation of fatigue cracks.

Figure 5:
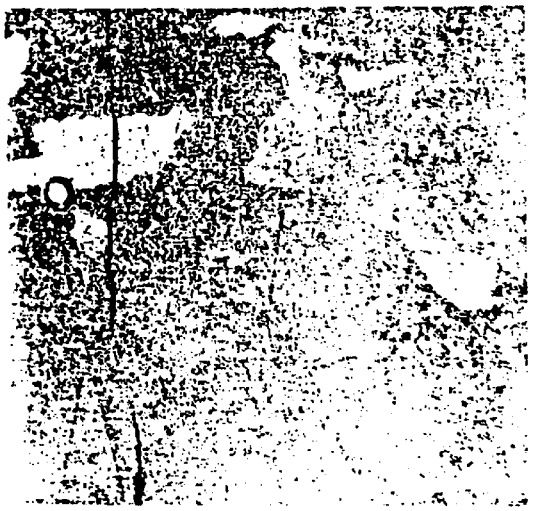
FIG. 5 is a photomicrograph of PWA 1480 material showing γ/γ' islands as preferential sites for fatigue cracking in hydrogen.

FIG. 5 shows that γ/γ' eutectic islands can act as crack initiation sites in PWA 1480 in a hydrogen atmosphere, with the cracks propagating readily into the matrix material.

Figure 6:
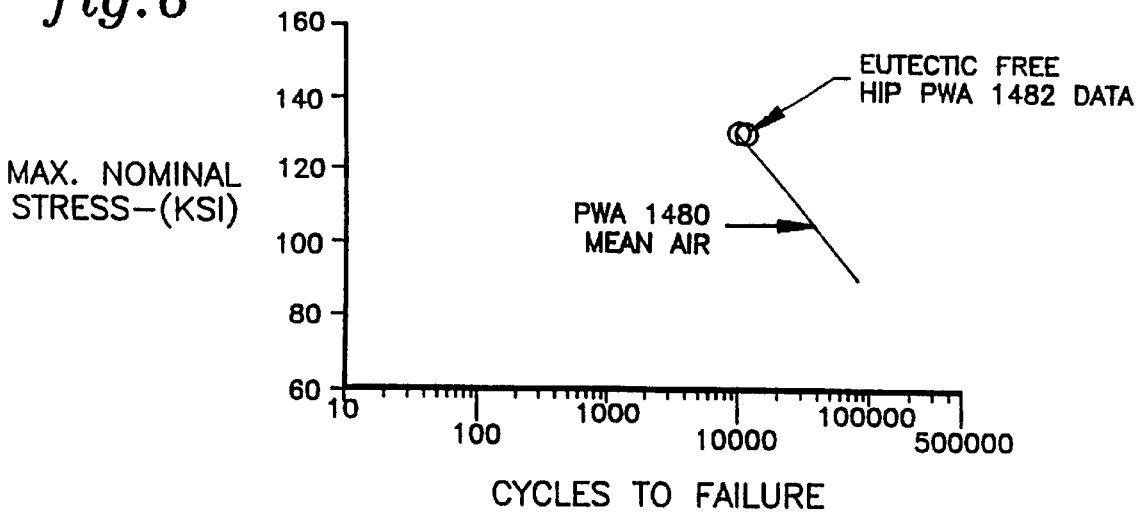
FIG. 6 is a graph comparing the relative low cycle fatigue (LCF) behavior in air of PWA 1482 processed according to the invention and conventionally processed PWA 1480.

Testing of various alloys satisfying the concepts embodied in the present invention showed a remarkable improvement in performance in a hydrogen atmosphere compared to their performance when not given a solution heat treatment that eliminated all the γ/γ' eutectic islands. Referring to FIG. 6, it is seen that the fatigue resistance in air at room temperature of eutectic-free pore-free PWA 1482, an alloy known to have lower fatigue strength when conventionally processed than PWA 1480, compares very favorably with conventionally processed PWA 1480, which is recognized as having fatigue capabilities superior to most other nickel base superalloys used in similar applications.

Figure 7:
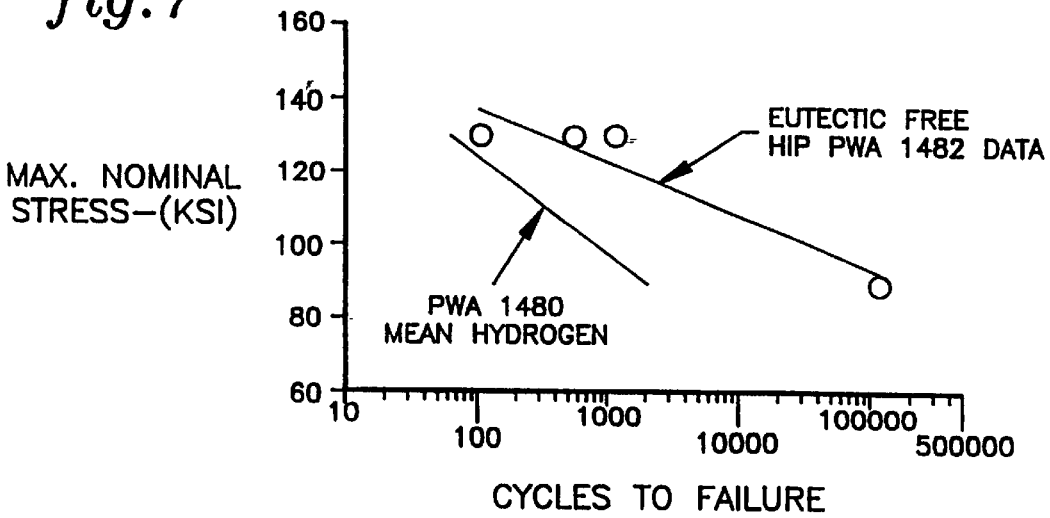
FIG. 7 is a graph comparing the relative LCF behavior in a hydrogen atmosphere of the same materials as shown in FIG. 6.

FIG. 7 shows that the fatigue life in hydrogen at room temperature of eutectic-free pore-free PWA 1482 is greatly improved compared to conventionally processed PWA 1480. The fatigue life of the eutectic free pore-free PWA 1482 is approximately five times greater at 130 KSI, and over fifty times greater at 90 KSI, than the fatigue life of conventionally processed PWA 1480.

It was determined that PWA 1480, which does not satisfy the requirements of the present invention in its nominal composition, could be adjusted in composition by going to the extreme low ends of the composition range for some of the critical elements. Accordingly, after reducing the aluminum and titanium contents to the minimum specification values, metallographic examination showed that the quantity of eutectic material present in the microstructure was greatly reduced demonstrating that the invention can be, applied in marginal situations.

Although this invention has been shown and described with respect to detailed embodiments thereof, it will be understood by those skilled in the art that various changes in form and detail thereof may be made without departing from the spirit and scope of the claimed invention.

TABLE 1

| | Cr | Ti | Mo | W | Ta | Al | Co | Re | Hf | Ni | C | B |
|---|---|---|---|---|---|---|---|---|---|---|---|---|
| PWA 1480[1] | 9.8 | 1.26 | — | 4 | 11.9 | 4.8 | 4.9 | — | — | | .05 Max | .003 Max |
| PWA 1482 | 9 | 1 | 1 | 6.8 | 6 | 5.5 | 5 | — | .15 | | .02 Max | .003 Max |
| PWA 1483 | 12 | 4.1 | 1.9 | 3.8 | 5 | 3.6 | 9 | — | — | | .07 Max | .02 Max |
| PWA 1480[2] | 10.0 | 1.5 | — | 4.0 | 12.0 | 5.0 | 5.0 | — | — | | .05 Max | .003 Max |
| Mar M 246 | 9.0 | 1.5 | 2.5 | 10.0 | 1.5 | 5.5 | 10.0 | — | — | Bal | 0.15 | 0.015 |
| PWA SP 1493 | 10.0 | 1.5 | — | 4.0 | 12.0 | 5.0 | 5.0 | — | — | Bal | 0.01 Max | 0.003 Max |
| 1480[2] | 10 | 1.5 | — | 4 | 12.0 | 5.0 | 5 | — | — | Bal | 0.05 Max | 0.003 Max |

compositions in weight percent
composition modified per this invention
final Composition

TABLE II

Range of Compositions Covered by This Invention

| Element | Minimum (wt. %) | Maximum (wt. %) |
|---|---|---|
| Ni | Remainder | Remainder |
| Cr | 9 | 12 |
| Al | 3.6 | 5.5 |
| W | 3.8 | 6.8 |
| Ta | 5 | 11.9 |
| Mo | 0 | 1.9 |
| Co | 4.9 | 9 |
| Ti | 1.0 | 4.1 |
| C | .02 | .17 |
| B | .003 | .320 |
| Zr | .007 | .15 |
| Y | .02 | .16 |
| Hf | .0 | .15 |
| Silicon* | | .56 |
| Manganese* | | .12 |
| Phosphorus* | | .015 |
| Sulfur* | | .015 |
| Iron* | | .20 |
| Copper* | | .10 |
| Lead* | | .0005 |
| Bismuth* | | .00003 |
| Selenium* | | .0001 |
| Tellurium* | | .00005 |
| Thallium* | | .00005 |

We claim:

1. A single crystal superalloy article which is resistant to hydrogen embrittlement, said article have a composition (by weight %) of 9–12 Cr
3.6–5.5 Al
3.8–6.8 W
5–11.9 Ta
0–1.9 Mo 4.9–9 Co
1.0–4.1 Ti
0.02–0.17 C
0.003–0.32 B
0.007–0.15 Zr
0.02–0.16 Y
0–0.15 Hf
Bal essentially Ni and wherein (W+Mo+Ta) is equal to or greater than about 10% said article having a single crystal structure and having been heat treated to dissolve and eliminate all γ/γ' eutectic islands without causing any incipient melting.

* * * * *